US007876283B2

(12) United States Patent
Bouche et al.

(10) Patent No.: US 7,876,283 B2
(45) Date of Patent: Jan. 25, 2011

(54) ANTENNA HAVING A DIELECTRIC STRUCTURE FOR A SIMPLIFIED FABRICATION PROCESS

(75) Inventors: Guillaume Bouche, Grenoble (FR); Sébastien Montusclat, Meylan (FR); Daniel Gloria, Detrier (FR)

(73) Assignee: STMicroelectronics S.A., Montrouge (FR)

( * ) Notice: Subject to any disclaimer, the term of this patent is extended or adjusted under 35 U.S.C. 154(b) by 1076 days.

(21) Appl. No.: 11/640,108

(22) Filed: Dec. 14, 2006

(65) Prior Publication Data

US 2007/0152884 A1 Jul. 5, 2007

(30) Foreign Application Priority Data

Dec. 15, 2005 (FR) ..... 05 12768

(51) Int. Cl.
*H01Q 9/28* (2006.01)
*H01Q 1/38* (2006.01)

(52) U.S. Cl. ..... 343/795; 343/700 MS

(58) Field of Classification Search ..... 343/700 MS, 343/795, 873
See application file for complete search history.

(56) References Cited

U.S. PATENT DOCUMENTS 5,940,036 A * 8/1999 Oliver et al. ..... 343/700 MS
6,556,169 B1 * 4/2003 Fukuura et al. ..... 343/700 MS
6,801,164 B2 * 10/2004 Bit-Babik et al. ..... 343/700 MS
7,183,975 B2 * 2/2007 Thomas et al. ..... 343/700 MS
2009/0236614 A1 * 9/2009 Puscasu et al. ..... 257/84

FOREIGN PATENT DOCUMENTS

FR 2 849 221 6/2004
WO WO 03030252 A2 4/2003

OTHER PUBLICATIONS

Guo, Yong Xin, et al., "On Improving Coupling Between a Coplanar Waveguide Feed and a Dielectric Resonator Antenna," IEEE Transactions on Antennas and Propagation, IEEE Service Center, Piscataway, NJ, US, vol. 51, No. 8, Aug. 2003, pp. 2144-2146; XP001169708; ISSN: 0018-926X.

Kishk, Ahmed A., "Application of Rotated Sequential Feeding for Circular Polarization Bandwidth Enhancement of Planar Arrays with Single-Fed DRA Elements," IEEE Antennas and Propagation Society International Symposium, 2003 Digest, APS, Columbus, OH, Jun. 22-27, 2003, New York, NY; IEEE, US, vol. 4 of 4, Jun. 22, 2003, pp. 664-667; XP010651334; ISBN; 0-7803-7846-6.

(Continued)

*Primary Examiner*—Shih-Chao Chen
(74) *Attorney, Agent, or Firm*—Gardere Wynne Sewell LLP

(57) ABSTRACT

An antenna is formed with a self-supporting structure (1), a dielectric structure (2), and a conducting structure (3), each structure being formed from at least one structural element (10; 21, 22; 31-34). The structural elements of the different structures (1, 2, 3) constitute a stack in which these elements (10; 21, 22; 31-34) are connected to each other, and the dielectric structure (2) is formed in the stack by nano-imprinting.

42 Claims, 7 Drawing Sheets

OTHER PUBLICATIONS

Petosa, et al., "Recent Advances in Dielectric-Resonator Antenna Technology," IEEE Antennas and Propagation Magazine, IEEE Service Center, Piscataway, NJ, US, vol. 40, No. 3, Jun. 1998, pp. 35-48; XP 000774845; ISSN: 1045-9243.

Puscasu, et al., "Near-Infrared Transmission and Emission Characteristics of Frequency Selective Surfaces and its Nano-Fabrication Issues," Conference on Lasers and Electro-Optics (CLEO 2001). Technical Digest, postconference edition, Baltimore, MD, May 6-11, 2001; Trends in Optics and Photonics, US, Washington, WA, OSA, US, vol. 56, May 6, 2001, p. 212; XP010559748; ISBN: 1-55752-662-1.

Preliminary French Search Report, FR 05 12768, dated Jun. 16, 2006, with French language Written Opinion.

* cited by examiner

ANTENNA HAVING A DIELECTRIC STRUCTURE FOR A SIMPLIFIED FABRICATION PROCESS

PRIORITY CLAIM

The present application claims priority from French Patent Application No. 05 12768 filed Dec. 15, 2005, the disclosure of which is hereby incorporated by reference.

BACKGROUND OF THE INVENTION

1. Technical Field of the Invention

In general, the invention concerns the techniques of large-scale production of components that are usable in the electronics industry.

More precisely, the invention concerns an antenna with a self-supporting structure, a dielectric structure, and a conducting structure, each structure being formed from at least one structural element.

2. Description of Related Art

The antennae, and in particular the antennae known as "3D," of the cone, V-dipole, or dielectric resonator type, have recently grown in popularity in all the applications requiring antennae that are compact and/or that have high directivity.

However, to the extent that these antennae are currently produced by precision micro-machining, their manufacture requires both a relatively long time and the use of costly materials.

SUMMARY OF THE INVENTION

In this context, this present invention has as its aim to propose an antenna that is capable of being manufactured more rapidly and/or more economically. To this end, the antenna of the invention, which also conforms to the generic description given in the above preamble, essentially comprises structural elements of the different structures which constitute a stack in which these elements are connected to each other, and wherein the dielectric structure is formed in the stack by shape pressing.

Through the use of this shape-pressing technique, which is also known as the "nano imprint" technique, the antenna of the invention can be manufactured at a high rate and at a relatively low cost.

Preferably, the conducting structure, whose thickness is typically not more than 10 microns, is formed by metal deposition, the dielectric structure being created in resin, and the self-supporting structure taking the form of a substrate sheet composed, for example, from a material chosen from silicon, glass, a polymer or a mixture of polymers, a ceramic, in particular a ceramic that has been vitrified at low temperature or a laminated ceramic, and a stable foam.

According to a first method of implementation of the invention, it is possible to arrange that the dielectric structure should include two prisms carried by the substrate sheet and having respective points positioned to face each other on the substrate in order to create a surface with two slopes forming a "V" that rises from the substrate, and that the conducting structure should include two electrical contacts placed in or on the substrate, and two conducting tracks positioned on the respective slopes of the "V" surface and connected respectively to the electrical contacts, with the antenna thus forming a V-dipole.

According to a second method of implementation of the invention, it is possible to arrange that the conducting structure should include at least one metallized plate deposited onto the substrate, and a conducting track placed in or on the substrate, that each metallized plate should be contiguous with a virgin plate on the substrate, that the conducting track should be insulated from each metallized plate, and that the dielectric structure should include at least one dielectric block deposited on a part of each metallized plate and covering the conducting track and the virgin plate at least partially, with the antenna thus forming a dielectric resonator antenna.

In this case, the virgin plate has a length, for example, that is equal to a dimension of the dielectric block that covers it.

The conducting structure can include at least two metallized plates, and the conducting track can be insulated from each of the metallized plates by a virgin plate on the substrate with at least two parallel slots.

The virgin plate can also include, for example, in addition to two parallel slots, a transverse slot that is totally covered by the dielectric block, connecting together the parallel slots and extending beyond them.

The dielectric block, which can essentially be parallelepiped in shape, can also have, on its free surface away from the substrate, a relief formed from crossed grooves.

However, the dielectric block can also take the form of a parallelepiped, which is chamfered asymmetrically or indeed in the form of a cylinder whose section in a plane across the direction of the stack is a rectangle with rebated corners.

The dielectric structure can also include a multiplicity of dielectric blocks whose section in a plane across the direction of the stack forms a fractal figure.

BRIEF DESCRIPTION OF THE DRAWINGS

Other characteristics and advantages of the invention will emerge more clearly from the description that follows, which is given as a guide only and in no way limiting, with reference to the appended drawings, none of which is to scale, and in which.

DETAILED DESCRIPTION OF THE DRAWINGS

Figure 1:
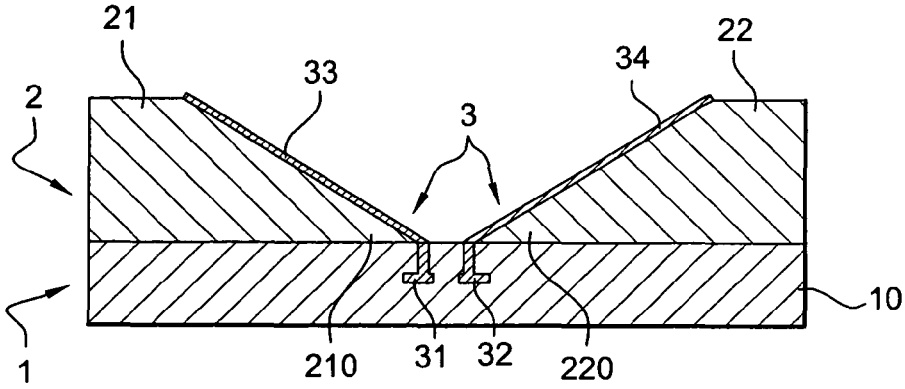
FIG. 1 is a view in section of an antenna according to a first method of implementation of the invention.

As mentioned above, the invention generally concerns an antenna with a self-supporting structure 1, a dielectric structure 2, and a conducting structure 3.

According to a first aspect of the invention, the structural elements, such as 10, 21, 22, and 31 to 37, which make up these different structures 1 to 3 and which will be described later in more detail, constitute a stack in which these elements are connected to each other.

And according to a second aspect of the invention, the dielectric structure 2, which is very advantageously created in resin, is formed in the stack by the nano-imprinting technique.

Typically, the self-supporting structure 1 takes the form of a substrate sheet 10 composed of a material selected from amongst silicon, glass, a polymer or a mixture of polymers, a ceramic, in particular a ceramic co-vitrified at low temperature or a laminated ceramic, and a stable foam, with the conducting structure 3 for its part being formed preferably by metal deposition of a thickness not exceeding 10 microns.

According to a first possible method of implementation of the invention illustrated in FIGS. 1 to 7, the antenna forms a V-dipole.

To this end, the substrate 10 is firstly equipped with two electrical contacts 31 and 32, which form elements of the conducting structure 3.

Figure 2:
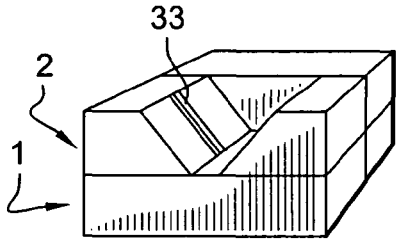
FIG. 2 is a view in perspective of the antenna illustrated in FIG. 1.
Figure 3:
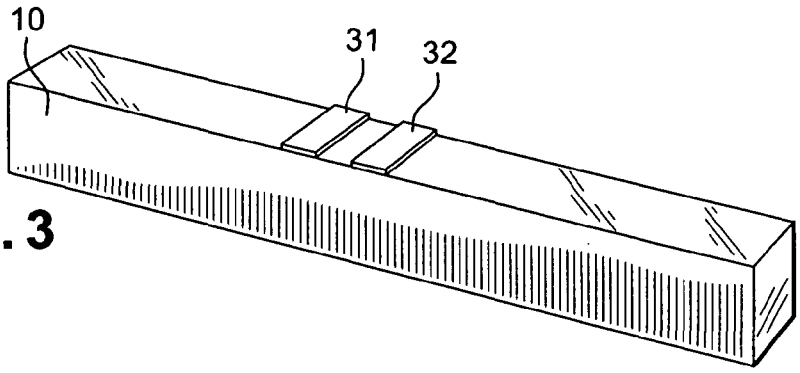
FIG. 3 illustrates a first stage of implementation of a variant of the antenna of FIG. 1, shown partially and in perspective.
Figure 7:
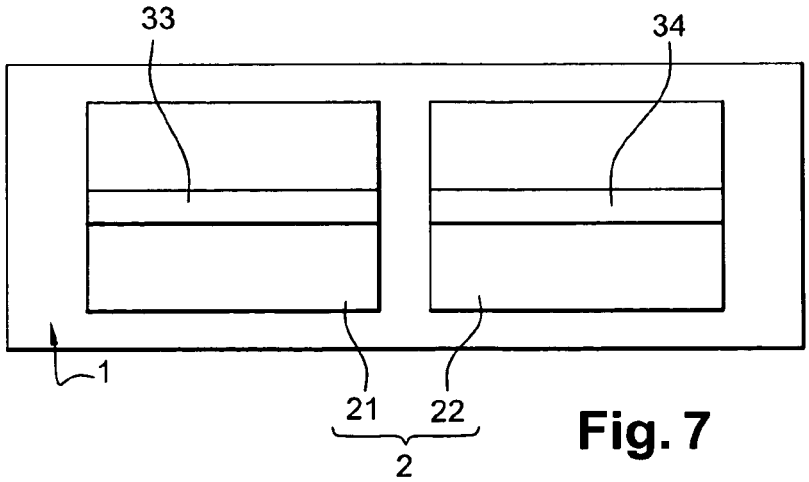
FIG. 7 is a plan view of the antenna illustrated in FIG. 1.

These contacts 31 and 32 can, for example, be implanted into the substrate 10 as shown in FIGS. 1, 2 and 7, or can be deposited onto the top surface of the substrate, as shown in FIGS. 3 to 6.

Figure 4:
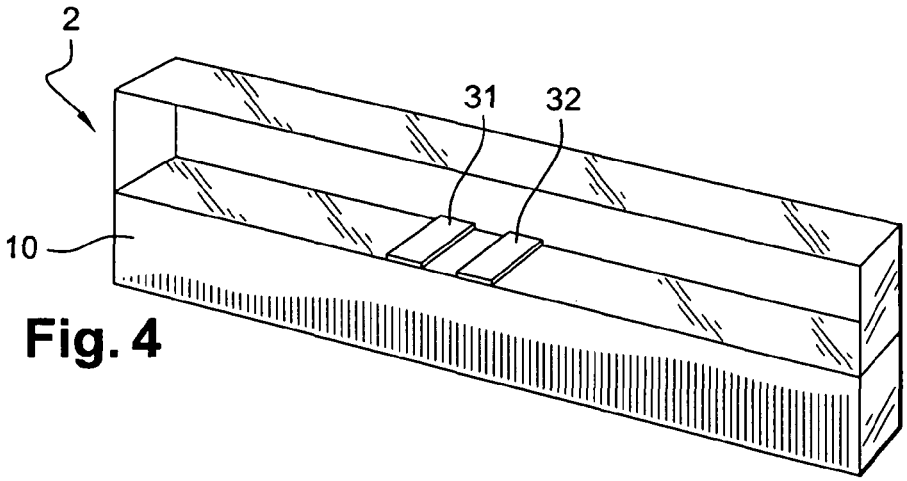
FIG. 4 illustrates a second stage of implementation of the antenna partially represented in FIG. 3.
Figure 5:
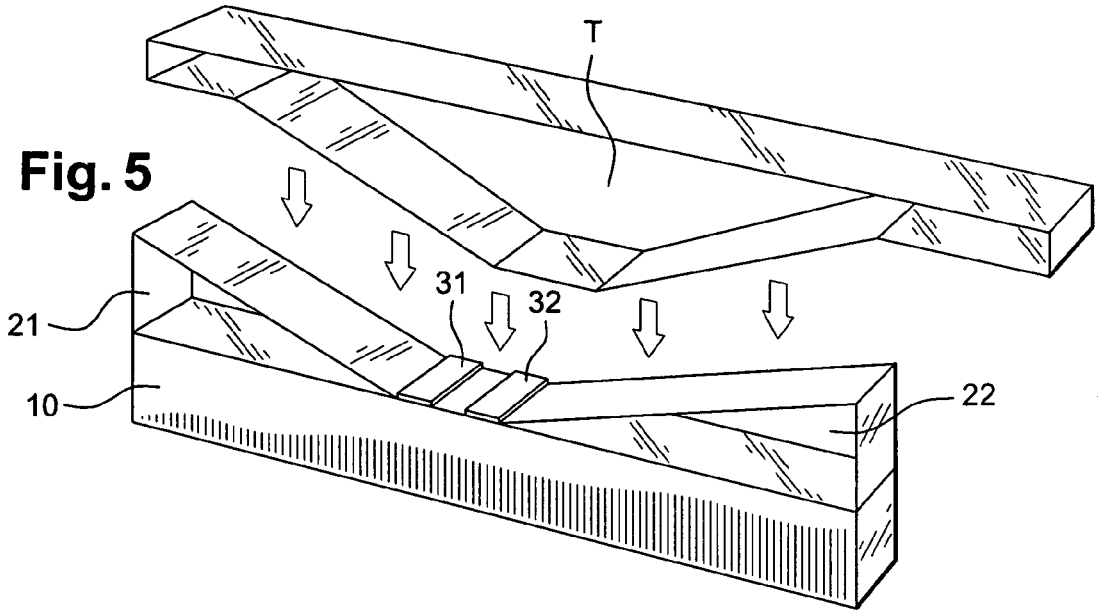
FIG. 5 illustrates a third stage of implementation of the antenna partially represented in FIG. 3.
Figure 6:
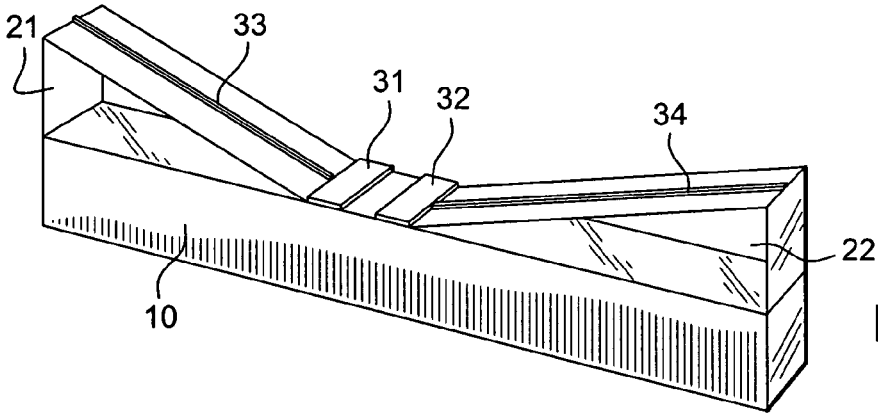
FIG. 6 illustrates a fourth stage of implementation of the antenna partially represented in FIG. 3.

The substrate is then covered with a layer of resin 2 in FIG. 4 which, before polymerization, is modeled by a T stamp as shown in FIG. 5. The resin constituting the dielectric structure 2 then assumes the form of two prisms 21 and 22 carried by the substrate sheet 10.

The prisms 21 and 22 possess respective points 210 and 220 positioned facing each other on the substrate 10 and creating a surface with two slopes forming a "V" that rises from the substrate 10, with contacts 31 and 32.

Finally, the conducting structure 3 is completed by the deposition of two conducting tracks 33 and 34 on the respective slopes of the "V" surface, these tracks 33 and 34 being connected respectively to the electrical contacts 31 and 32.

Typically, the tracks 33 and 34 both rise to about 45 degrees from the top surface of the substrate, each with a length Lp such that $0.1<Lp<10$ millimeters, and are separated at the lowest point of the slopes by a distance of the order of 5 to 10 microns, with the electrical contacts 31 and 32 each having a width of the order of 10 to 20 microns and corresponding to their horizontal dimension in FIG. 1.

According to a possible second method of implementation of the invention, illustrated in FIGS. 8 to 23, the antenna forms a dielectric resonator antenna. To this end, the substrate 10 is equipped with a conducting track 37 which constitutes a first element of the conducting structure 3, and is covered at least partially with one or more metallized plates, such as 35 and 36, which constitute other elements of the conducting structure 3.

Figure 8:
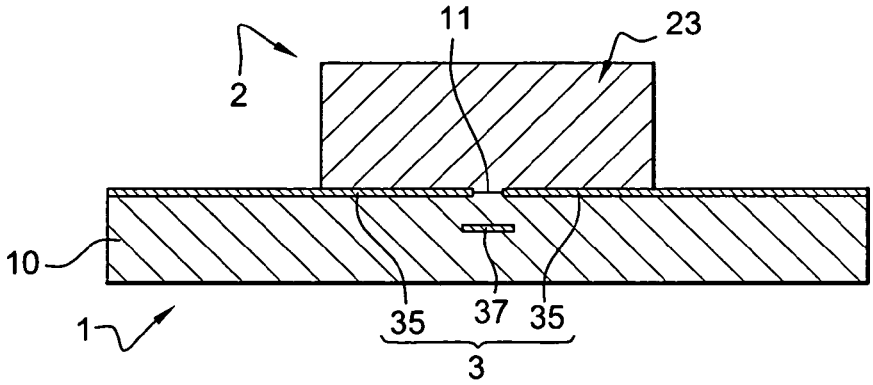
FIG. 8 is a view in section of an antenna constituting a first variant of a possible second method of implementation of the invention.

The track 37 can, for example, be implanted into the substrate 10 as shown in FIG. 8, or be deposited onto the top surface of the substrate as shown in FIGS. 11 to 16.

The metallized plate, or each of the metallized plates, is contiguous with a virgin plate 11 on the substrate, and insulated electrically from the conducting track 37.

The dielectric structure 2 includes one or more dielectric blocks, such as 23, 24*a*, 24*b*, etc. deposited onto a part of the metallized plate 35 or of each of the metallized plates 35 and 36.

Each dielectric block is shaped in the stack by nano-imprinting and at least partially covers the conducting track 37 and the virgin plate 11.

The dielectric block 23 can be essentially parallelepiped in shape, and then typically has a height of the order of one millimeter and corresponding to its vertical dimension in FIGS. 8, 11, 14, 18, 20, and 22, a length of the order of a few millimeters and corresponding to its horizontal dimension in FIGS. 10, 13, 16, 18, and 20 to 22, and a width of the order of a few hundreds of microns and corresponding to its vertical dimension in FIGS. 10, 13, 16, and 21.

Figure 11:
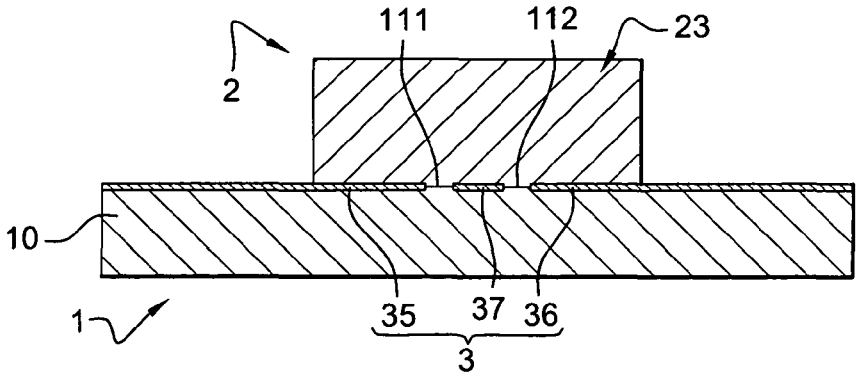
FIG. 11 is a view in section of an antenna constituting a second variant of the possible second method of implementation of the invention.
Figure 14:
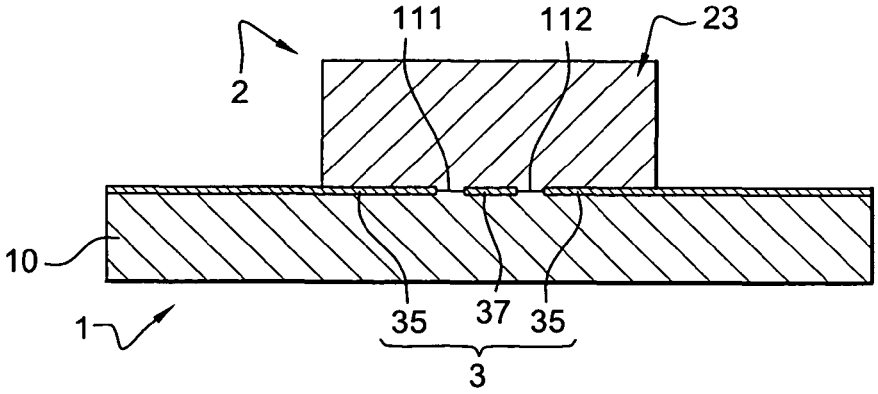
FIG. 14 is a view in section of an antenna constituting a third variant of the possible second method of implementation of the invention.

The conducting track 37 for its part has a width that is preferably less than 10 microns and corresponding to its horizontal dimension in FIGS. 8, 11 and 14. Many variants of implementation are possible.

Figure 9:
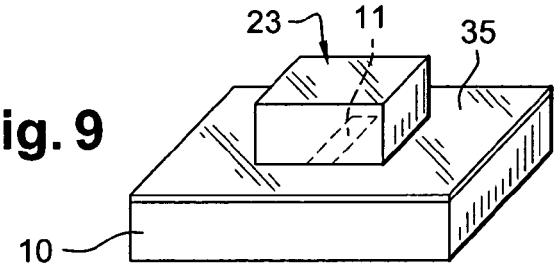
FIG. 9 is a view in perspective of the antenna illustrated in FIG. 8.
Figure 10:
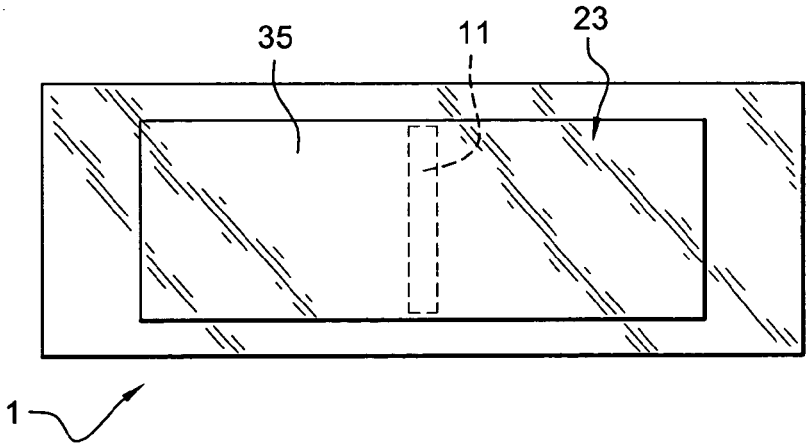
FIG. 10 is a plan view of the antenna illustrated in FIG. 8.

For example, as shown in FIGS. 8 to 10, the substrate 10 can be covered with a single metallized plate 35, leaving on the substrate a virgin plate 11 that is composed of a single slot whose vertical length in FIG. 10 is equal to the width of the dielectric block 23 that covers it totally.

Figure 12:
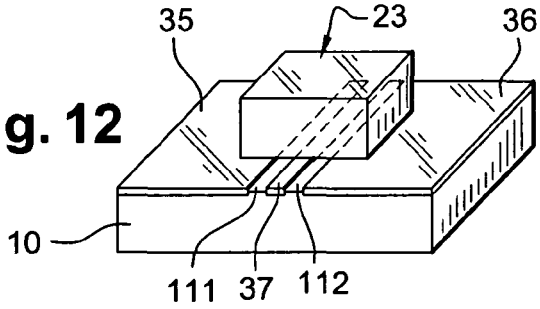
FIG. 12 is a view in perspective of the antenna illustrated in FIG. 11.
Figure 13:
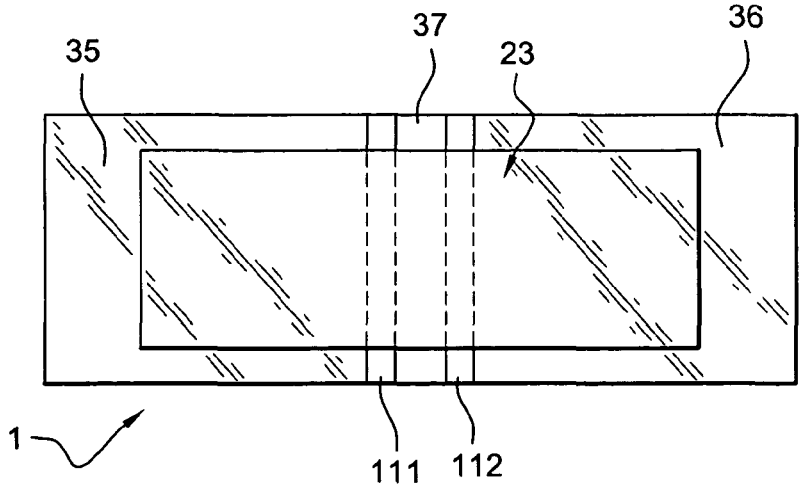
FIG. 13 is a plan view of the antenna illustrated in FIG. 11.

As shown in FIGS. 11 to 13, the substrate 10 can also be covered with two metallized plates 35 and 36 leaving on this substrate a virgin plate 11 composed of two parallel slots 111 and 112.

Each of these slots has a width that is preferably less than 20 microns and corresponding to its horizontal dimension in FIG. 13, isolates the conducting track 37 from the metallized plate 35 or 36 which is contiguous with it, and is only partially covered by the dielectric block 23.

Figure 15:
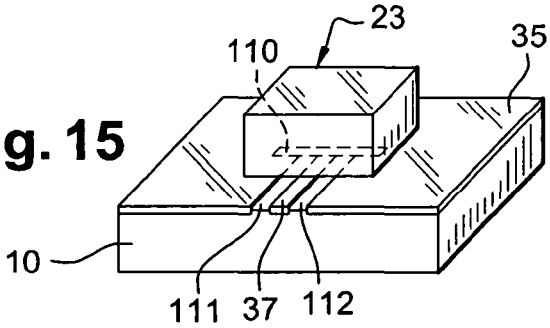
FIG. 15 is a view in perspective of the antenna illustrated in FIG. 14.
Figure 16:
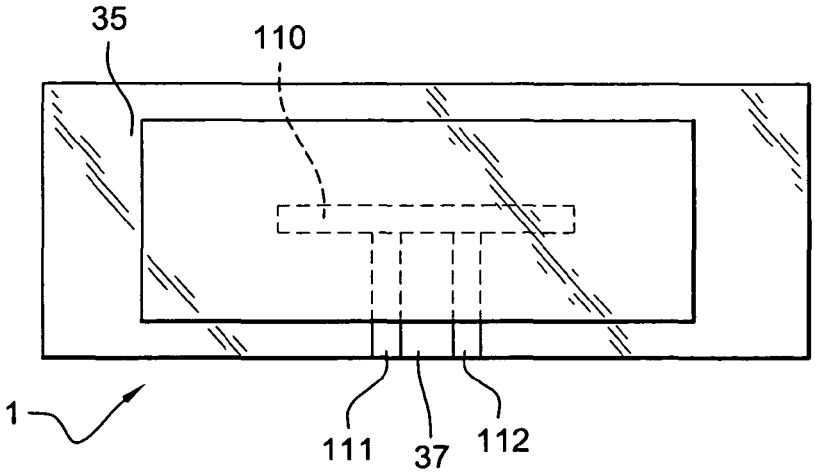
FIG. 16 is a plan view of the antenna illustrated in FIG. 14.

According to another variant, illustrated in FIGS. 14 to 16, the virgin plate 11 includes, in addition to two parallel slots 111 and 112, a transverse slot 110 which is totally covered by the dielectric block 23 in the direction of its length, and which connects together the parallel slots 111 and 112 and extends beyond them.

In addition, the dielectric block 23 can have a shape that differs somewhat from a parallelepiped.

Figure 17:
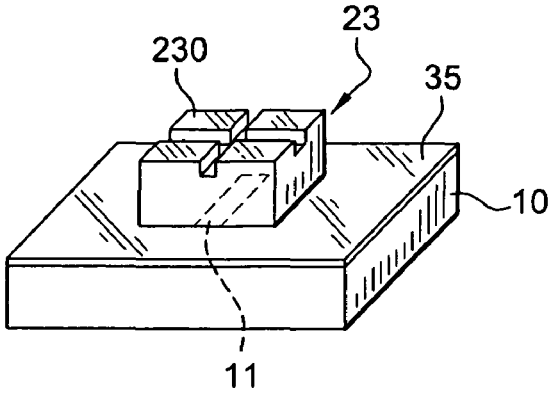
FIG. 17 is a view in perspective of an antenna constituting a fourth variant of the possible second method of implementation of the invention.
Figure 18:
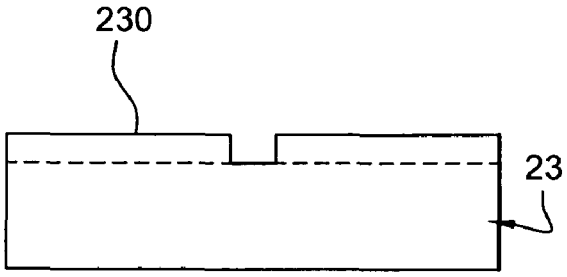
FIG. 18 is a partial side view of an enlarged detail of the antenna illustrated in FIG. 17.
Figure 19:
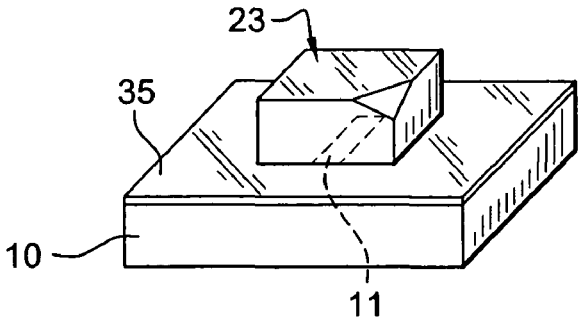
FIG. 19 is a view in perspective of an antenna constituting a fifth variant of the possible second method of implementation of the invention.
Figure 20:
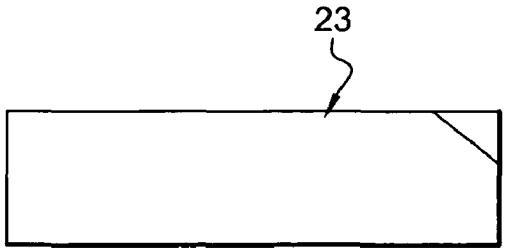
FIG. 20 is a partial side view of an enlarged detail of the antenna illustrated in FIG. 19.
Figure 21:
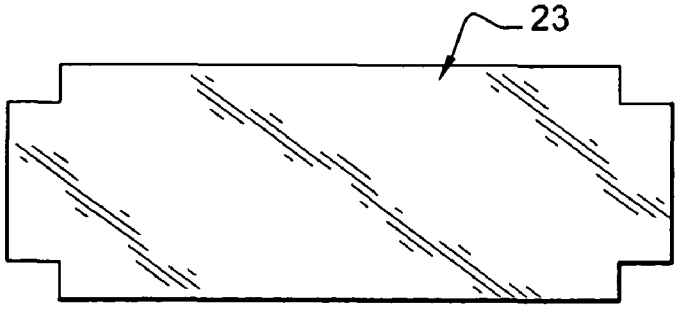
FIG. 21 is a view in section of the dielectric structure of an antenna constituting a sixth variant of the possible second method of implementation of the invention.
Figure 22:
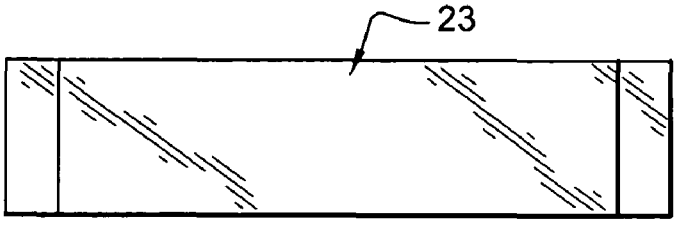
FIG. 22 is a side view of the dielectric structure illustrated in FIG. 21.

For example, as illustrated in FIGS. 17 and 18, the block 23 can include, on its free surface 230 away from the substrate 10, a relief formed of crossed grooves.

The dielectric block 23 can also take (FIGS. 19 and 20) the form of a parallelepiped, that is chamfered asymmetrically.

The dielectric block 23 can also (FIGS. 21 and 22) assume the form of a cylinder whose section in a plane across the direction of the stack is a rectangle with rebated corners, with the term "cylinder" being used here in the broad sense of a solid limited by all of the parallel lines which fall on any given closed curve and which are intercepted by two mutually parallel planes.

Figure 23:
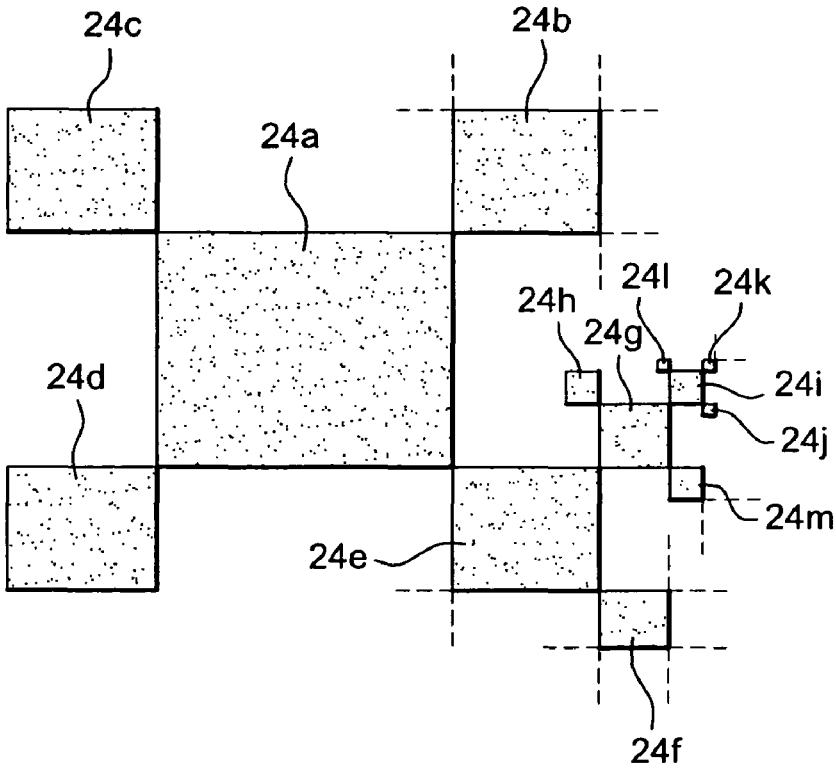
FIG. 23 is a view in section of the dielectric structure of an antenna constituting a seventh variant of the possible second method of implementation of the invention.

As shown in a non-limiting manner in FIG. 23, the dielectric structure 2 can also include a multiplicity of dielectric blocks, such as 24*a* to 24*m*, whose section in a plane across the direction of the stack forms a fractal figure, where this figure can be drawn either positively or negatively.

The different examples of shapes of the dielectric structure are given in a non-limiting manner, and other shapes can be chosen equally well in order to obtain other radiation diagrams.

The invention claimed is:

1. An antenna with a self-supporting structure, a nano-imprinted dielectric structure, and a conducting structure, with each structure being formed from at least one structural element, the structural elements of the different structures constituting a stack in which these structural elements are connected to each other;

wherein the dielectric structure includes two prisms carried by a substrate and having respective points positioned facing each other on the substrate in order to create a surface with two slopes forming a "V" that rises from the substrate, and in that the conducting structure includes two electrical contacts placed in or on the substrate, and two conducting tracks positioned on the respective slopes of the "V" surface and connected respectively to the electrical contacts, with the said antenna thus forming a V-dipole.

2. An antenna according to claim 1, wherein the conducting structure is formed by metal deposition.

3. An antenna according to claim 1, wherein the self-supporting structure takes the form of a substrate sheet composed of a material selected from the group consisting of silicon, glass, a polymer or a mixture of polymers, a ceramic, in particular a ceramic vitrified at low temperature or a laminated ceramic, and a stable foam.

4. An antenna according to claim 1, wherein the nano-imprinted dielectric structure is created in resin.

5. An antenna with a self-supporting structure, a nano-imprinted dielectric structure, and a conducting structure, with each structure being formed from at least one structural element, the structural elements of the different structures constituting a stack in which these structural elements are connected to each other;

wherein the conducting structure includes at least one metallized plate deposited onto a substrate, and a conducting track placed in or on the substrate, in that each metallized plate is contiguous with a virgin plate on the substrate, in that the conducting track is insulated from each metallized plate, and in that the dielectric structure includes at least one dielectric block deposited on a part of each metallized plate and at least partially covering the conducting track and the virgin plate, with the said antenna thus forming a dielectric resonator antenna.

6. An antenna according to claim 5, wherein the virgin plate has a length equal to a dimension of the dielectric block that covers it.

7. An antenna according to claim 5, wherein the conducting structure includes at least two metallized plates and in that the conducting track is insulated from each of the metallized plates by the virgin plate on the substrate with at least two parallel slots.

8. An antenna according to claim 5, wherein the virgin plate includes, in addition to two parallel slots, a transverse slot totally covered by the dielectric block, connecting together the parallel slots and extending beyond them.

9. An antenna according to claim 5, wherein the dielectric block is essentially parallelepiped in shape.

10. An antenna according to claim 5, wherein the dielectric block has, on its free surface away from the substrate, a relief formed by crossed grooves.

11. An antenna according to claim 5, wherein the dielectric block has the shape of a parallelepiped that is chamfered asymmetrically.

12. An antenna according to claim 5, wherein the dielectric block has the shape of a cylinder whose section in a plane across the direction of the stack is a rectangle with rebated corners.

13. An antenna according to claim 5, wherein the dielectric structure includes a multiplicity of dielectric blocks whose section in a plane across the direction of the stack form a fractal figure.

14. An antenna according to claim 5, wherein the conducting structure has a thickness not exceeding 10 microns.

15. A semiconductor antenna structure, comprising:

a substrate;

a pair of contacts formed at a top surface of the substrate;

a resin layer overlying the substrate and including an impression having a V-shaped cross-section which exposes the pair of contacts and forms an opposed pair of sloped surfaces; and a pair of conducting tracks formed on the opposed pair of sloped surfaces and electrically connected to the pair of contacts.

16. A method for forming a semiconductor antenna structure, comprising:

providing a substrate;

forming a pair of contacts at a top surface of the substrate;

depositing a resin layer overlying the substrate;

making an impression in the resin layer having a V-shaped cross-section which exposes the pair of contacts and forms an opposed pair of sloped surfaces; and forming a pair of conducting tracks on the opposed pair of sloped surfaces which are electrically connected to the pair of contacts.

17. A semiconductor dielectric resonator antenna structure, comprising:

a substrate including a conducting track embedded under a top surface of the substrate;

at least one metallized plate on the top surface of the substrate which partially overlies the embedded conducting track and does not overlie the embedded conducting track in a virgin surface region; and a nano-imprinted dielectric block overlying at least a part of the at least one metallized plate and fully covering the virgin surface region.

18. The structure of claim 17 wherein the virgin surface region comprises a first and second parallel slots formed in the metallized plate.

19. The structure of claim 18 wherein the virgin surface region further comprises a third slot formed in the metallized plate, perpendicular and connected to the first and second parallel slots.

20. The structure of claim 17 wherein the dielectric block is parallelepidal.

21. The structure of claim 17 wherein the dielectric block is cylindrical.

22. The structure of claim 17 wherein the dielectric block has a top surface and further includes a relief structure formed on the top surface of the dielectric block.

23. The structure of claim 22 wherein the relief structure comprises at least one groove formed in the top surface of the dielectric block.

24. The structure of claim 22 wherein the relief structure comprises a pair of crossed grooves formed in the top surface of the dielectric block.

25. The structure of claim 17 wherein the dielectric block has a top surface and at least one edge and further includes a chamfer formed at the edge of the top surface.

26. A method for forming a semiconductor dielectric resonator antenna structure, comprising:

providing a substrate including a conducting track embedded under a top surface of the substrate;

forming at least one metallized plate on the top surface of the substrate which partially overlies the embedded conducting track and does not overlie the embedded conducting track in a virgin surface region; and nano-imprinting a dielectric block overlying at least a part of the at least one metallized plate and fully covering the virgin surface region.

27. The method of claim 26 further comprising forming a first and second parallel slots in the metallized plate as the virgin surface region.

28. The method of claim 27 further comprising forming a third slot in the metallized plate, perpendicular and connected to the first and second parallel slots.

29. The method of claim 26 wherein the dielectric block has a top surface, further comprising forming a relief structure on the top surface of the dielectric block.

30. The method of claim 29 wherein forming a relief structure comprises forming at least one groove in the top surface of the dielectric block.

31. The method of claim 30 wherein the formed relief structure comprises a pair of crossed grooves in the top surface of the dielectric block.

32. The method of claim 26 wherein the dielectric block has a top surface and at least one edge, further comprising forming a chamfer at the edge of the top surface.

33. An antenna with a self-supporting structure, a dielectric structure, and a conducting structure, with each structure being formed from at least one structural element, the structural elements of the different structures constituting a stack in which these structural elements are connected to each other, and wherein the dielectric structure is formed in the stack by nano-imprinting;

wherein the self-supporting structure takes the form of a substrate sheet composed of a material selected from the group consisting of silicon, glass, a polymer or a mixture of polymers, a ceramic, in particular a ceramic vitrified at low temperature or a laminated ceramic, and a stable foam;

wherein the dielectric structure includes two prisms carried by the substrate sheet and having respective points positioned facing each other on the substrate sheet in order to create a surface with two slopes forming a "V" that rises from the substrate sheet, and in that the conducting structure includes two electrical contacts placed in or on the substrate sheet, and two conducting tracks positioned on the respective slopes of the "V" surface and connected respectively to the electrical contacts, with the said antenna thus forming a V-dipole.

34. An antenna with a self-supporting structure, a dielectric structure, and a conducting structure, with each structure being formed from at least one structural element, the structural elements of the different structures constituting a stack in which these structural elements are connected to each other, and wherein the dielectric structure is formed in the stack by nano-imprinting;

wherein the self-supporting structure takes the form of a substrate sheet composed of a material selected from the group consisting of silicon, glass, a polymer or a mixture of polymers, a ceramic, in particular a ceramic vitrified at low temperature or a laminated ceramic, and a stable foam;

wherein the conducting structure includes at least one metallized plate deposited onto the substrate sheet, and a conducting track placed in or on the substrate sheet, in that each metallized plate is contiguous with a virgin plate on the substrate sheet, in that the conducting track is insulated from each metallized plate, and in that the dielectric structure includes at least one dielectric block deposited on a part of each metallized plate and at least partially covering the conducting track and the virgin plate, with the said antenna thus forming a dielectric resonator antenna.

35. An antenna according to claim 34, wherein the virgin plate has a length equal to a dimension of the dielectric block that covers it.

36. An antenna according to claim 34, wherein the conducting structure includes at least two metallized plates and in that the conducting track is insulated from each of the metallized plates by the virgin plate on the substrate sheet with at least two parallel slots.

37. An antenna according to claim 34, wherein the virgin plate includes, in addition to two parallel slots, a transverse slot totally covered by the dielectric block, connecting together the parallel slots and extending beyond them.

38. An antenna according to claim 34, wherein the dielectric block is essentially parallelepiped in shape.

39. An antenna according to claim 34, wherein the dielectric block has, on its free surface away from the substrate sheet, a relief formed by crossed grooves.

40. An antenna according to claim 34, wherein the dielectric block has the shape of a parallelepiped that is chamfered asymmetrically.

41. An antenna according to claim 34, wherein the dielectric block has the shape of a cylinder whose section in a plane across the direction of the stack is a rectangle with rebated corners.

42. An antenna according to claim 34, wherein the dielectric structure includes a multiplicity of dielectric blocks whose section in a plane across the direction of the stack form a fractal figure.

* * * * *